US006022263A

United States Patent [19]

Liu et al.

[11] Patent Number: 6,022,263

[45] Date of Patent: Feb. 8, 2000

[54] MECHANICAL TOY FIGURES

[75] Inventors: Dexter C. T. Liu, Portsmouth, R.I.; Douglas Melville, Jr., Simsbury, Conn.

[73] Assignee: LCD International, L.L.C., Newport, R.I.

[21] Appl. No.: 09/045,741

[22] Filed: Mar. 20, 1998

[51] Int. Cl.[7] ..... A63H 3/20; A63H 3/46

[52] U.S. Cl. ..... 446/379; 446/330; 446/376

[58] Field of Search ..... 446/330, 334, 446/336, 338, 339, 340, 390, 376, 379–381

[56] References Cited

U.S. PATENT DOCUMENTS

| | | | |
|---|---|---|---|
| 3,147,566 | 9/1964 | Ong . | |
| 3,599,364 | 8/1971 | Garcia . | |
| 3,648,405 | 3/1972 | Tepper . | |
| 3,775,900 | 12/1973 | Thorn et al. . | |
| 3,862,513 | 1/1975 | Isaacson et al. . | |
| 3,928,934 | 12/1975 | Lewis et al. . | |
| 3,955,311 | 5/1976 | Lyons et al. . | |
| 4,003,158 | 1/1977 | Wolf et al. . | |
| 4,040,206 | 8/1977 | Kimura . | |
| 4,073,088 | 2/1978 | Beny et al. . | |
| 4,141,176 | 2/1979 | Flicker et al. . | |
| 4,217,726 | 8/1980 | Flicker et al. . | |
| 4,507,098 | 3/1985 | Terzian et al. | 446/288 |
| 4,601,672 | 7/1986 | Cook et al. | 446/330 |
| 4,623,318 | 11/1986 | Tsiknopoulos et al. . | |
| 4,657,518 | 4/1987 | Kelley et al. . | |
| 4,723,932 | 2/1988 | Kelley et al. . | |
| 4,968,280 | 11/1990 | Kelley . | |
| 5,088,954 | 2/1992 | Terzian et al. | 446/335 |
| 5,236,385 | 8/1993 | May | 446/300 |
| 5,413,517 | 5/1995 | Kamijima . | |
| 5,727,982 | 3/1998 | Hurt | 446/352 |

*Primary Examiner*—Robert A. Hafer
*Assistant Examiner*—Laura Fossum
*Attorney, Agent, or Firm*—Akin, Gump, Strauss, Hauer & Feld, L.L.P.

[57] ABSTRACT

A toy figure includes a lower torso, an upper torso rotatably attached to the lower torso, and a head and two arms each rotatably attached to the upper torso. A spring connected with the lower torso and the upper torso rotates the upper torso from a second to a first position with respect to the lower torso. A friction clutch retards rotation of the upper torso about the lower torso. A drive gear is connected with the lower torso. Two driven gears are engaged with the drive gear and mounted to a separate arm shaft of the arms. The driven gears roll around the drive gear and rotate the arms in opposite directions when the upper torso rotates about the lower torso. Upper and lower arm sections can be fixed together or hinged. Where hinged, a linkage between the lower arm and upper torso rotates each lower arm section about an upper arm section as the arm rotates about the upper torso. A neck shaft is attached to the head, pivotally mounted to a pivot shaft and connected with a moveable member, such that rotation of the upper torso about the lower torso moves the moveable member to pivot the neck shaft and the head. Alternatively, a cam is connected with the lower torso and the neck shaft has an end contacting the cam, so that rotation of the upper torso about the lower torso moves the end of the neck shaft along the cam surface to move the head.

34 Claims, 6 Drawing Sheets

MECHANICAL TOY FIGURES

BACKGROUND OF THE INVENTION

The present invention relates to mechanical toy figures and, more specifically, to mechanical toy figures having mechanisms for rotating body parts of the figure.

Mechanical figures having mechanisms for rotating different body parts of a figure are known. For example, U.S. Pat. No. 3,147,566 of Ong, U.S. Pat. No. 3,648,405 of Tepper and U.S. Pat. No. 4,657,518 of Kelley et al. each discloses a toy doll having a different gear train for rotating the arms about the torso of the doll. The mechanical doll disclosed in Kelley et al. further includes a motion-delay mechanism, which is an inertia-providing member attached to the gear train, that retards the rotation of the arms about the torso of the doll. Further, toy figures having gear trains for rotating both arms with respect to the upper torso when the upper torso is rotated about the lower torso are shown in U.S. Pat. No. 4,723,932 of Kelley et al.

Furthermore, toy figures having a mechanism for returning parts of the figure body to an initial position with respect to other parts of the figure body are known, such as the toy figure disclosed in U.S. Pat. No. 3,928,934 of Lewis et al. In Lewis et al., the upper torso of a toy figure is spring-biased to return to an initial position with respect to the lower torso and includes a locking mechanism that holds the upper torso at a displaced position. Furthermore, a mechanical figure having a gear train for rotating the head and one arm about the upper torso when the lower torso is pivoted about the upper torso is shown in Tepper. With the Tepper doll, a user twists the upper torso about the lower torso so that a first crown gear fixed to the lower torso rotates a spur gear connected with one arm to rotate the arm about the upper torso. The spur gear also drives a second crown gear attached to a neck shaft to rotate the head.

Although mechanical figures having various mechanisms for rotating one or more body parts about the remainder of the figure are known, such as those described above, the known toy figures are generally limited to is moving only one or two body parts and do not realistically simulate complex, coordinated human motion. Therefore, it would be desirable to provide a toy figure that simultaneously rotates the head and both arms as the upper torso rotates about the lower torso, particularly one that rotates the various body parts at a controlled rate so as to simulate normal human motion rather than jerky, spasmodic movement. Further, it would be desirable to have a toy figure that can rotate the lower arm with respect to the upper arm, particularly when the upper arm rotates about the torso to provide an even more realistic motion.

BRIEF SUMMARY OF THE INVENTION

In a first aspect, the present invention is a toy figure comprising a lower torso and an upper torso rotatably attached to the lower torso. A spring has a first end connected with the lower torso and a second end connected with the upper torso so as to rotate the upper torso from a second position with respect to the lower torso where the spring is deflected to a first position with respect to the lower torso where the spring is undeflected. Friction means retard rotation of the upper torso about the lower torso when the upper torso moves from the second position to the first position.

In a second aspect, the present invention is also a toy figure comprising a lower torso, an upper torso rotatably attached to the lower torso, and a head rotatably attached to the upper torso. A cam surface is connected with the lower torso. A neck shaft extends into the upper torso, the neck shaft having a first end attached to the head and a second end contacting the cam surface. The neck shaft is supported on the upper torso such that rotation of the upper torso with respect to the lower torso moves the second end of the neck shaft along the cam surface, thereby moving the head with respect to the upper torso in at least one direction.

In a third aspect, the present invention is also a toy figure comprising a lower torso and an upper torso rotatably attached to the lower torso, the upper torso having two shoulder regions. Two arms are rotatably connected to a separate one of the shoulder regions of the upper torso, each arm having an arm shaft extending into the upper torso. A drive gear is connected with the lower torso and is disposed within the upper torso, the drive gear having an axis. Two driven gears are engaged with the drive gear. Each driven gear is connected with a separate one of the arm shafts and has an axis extending perpendicular to and intersecting the axis of the drive gear such that rotation of the upper torso with respect to the lower torso causes the driven gears to move around the drive gear and rotate the arms in opposite directions.

In a fourth aspect, the present invention is also a toy figure comprising a lower torso, an upper torso rotatably attached to the lower torso, and two arms rotatably attached to the upper torso. A spring has a first end connected with the upper torso and a second end connected with the lower torso, the spring being positioned to bias the upper torso toward a first position with respect to the lower torso. A drive gear is connected with the lower torso. At least one driven gear is disposed within the upper torso, connected with at least one of the two arms and engaged with the drive gear such that release of the upper torso from a second position with respect to the lower torso spaced from the first position permits the spring to bias the upper torso to rotate about the lower torso toward the first position and drive the driven gear about the drive gear so that the at least one of the two arms rotates about the upper torso. A motion-damping mechanism has a first end connected with the lower torso and a second end connected with the upper torso so as to retard rotation of the upper torso about the lower torso and thereby retard rotation of at least one of the arms about the upper torso.

In a fifth aspect, the present invention is also a toy figure comprising a lower torso, an upper torso rotatably attached to the lower torso and two arms rotatably attached to the upper torso. The toy figure also comprises means for rotating the upper torso with respect to the lower torso from a second position with respect to the lower torso to a first position with respect to the lower torso, means for rotating the arms with respect to the upper torso as the upper torso rotates about the lower torso and means for retarding rotation of the upper torso with respect to the lower torso. Releasing the upper torso from the second position with respect to the lower torso causes the upper torso to rotate about the lower torso toward the first position and simultaneously rotates the arms about the upper torso, the rotations being retarded by the means for retarding.

In a sixth aspect, the present invention is also a toy figure comprising a body and at least one arm rotatably connected to the body. The arm has an upper arm section rotatably connected to the body and a lower arm section rotatably attached to the upper arm section. A linkage is attached to the lower arm section and to the body such that the lower arm section rotates with respect to the upper arm section as the upper arm section rotates with respect to the body.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings, which are diagrammatic, embodiments which are presently preferred. It should be understood, however, that the invention is not limited to the precise arrangements and instrumentalities shown. In the drawings.

DETAILED DESCRIPTION OF THE INVENTION

Figure 2:
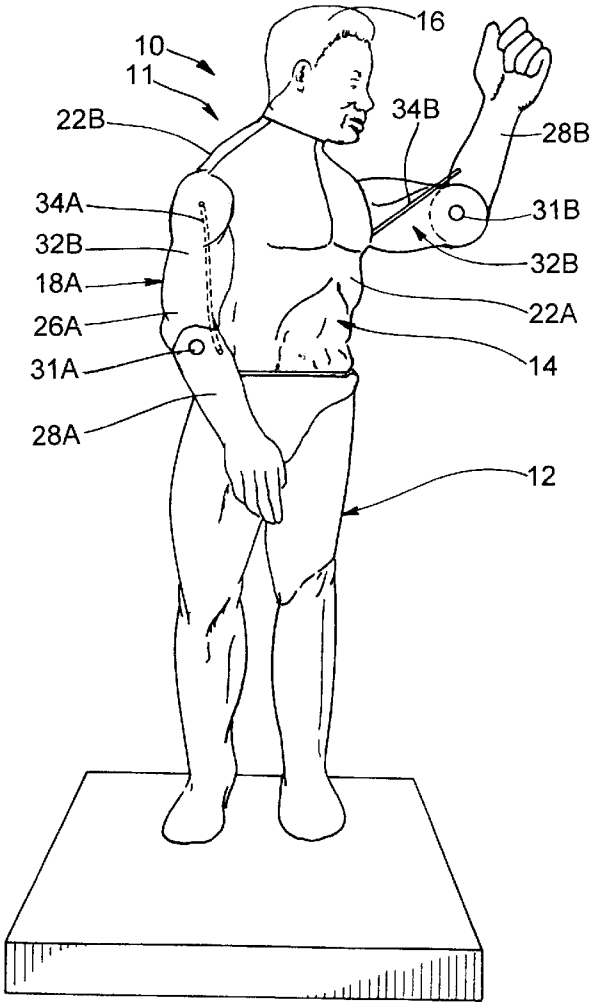
FIG. 2 is a perspective view of the toy figure shown in FIG. 1, showing the head, arms and upper torso in a second position.

Certain terminology is used in the following description for convenience only and is not limiting. The words "right", "left", "lower", "upper", "upward", "down", and "downward" designate directions in the drawings to which reference is made. It must be emphasized that "right" and "left" refer to the directions as shown in the drawings and are used in the opposite sense to the conventional designation of left and right body parts. In particular the designations of a "right arm" and a "left arm" refer to the particular arm at the right and left sides of the drawings, respectively, but are actually the left and right arms, respectively, of the figures. Further, the words "inner", "inwardly" and "outer", "outwardly" refer to directions toward or away from, respectively, the designated centerline of the toy figure and the words "front", "frontward" and "rear", "rearward" refer to directions toward and away from, respectively, the designated front of the toy figure. The terminology includes the words above specifically mentioned, derivatives thereof, and words of similar import.

Referring now to the drawings in detail, wherein like numerals are used to indicate like elements throughout, there shown in FIGS. 1–6B a first preferred embodiment of a mechanical toy figure 10. The toy figure 10 comprises a body 11 itself comprising a lower torso 12 and an upper torso 14 rotatably attached to the lower torso 12 so as to rotate about a vertical centerline 19 extending through the upper and lower torsos 12, 14, respectively. A head 16 is rotatably attached to the upper torso 14 and at least one arm 18, and preferably two arms 18A, 18B, are rotatably attached to the upper torso 14. The FIG. 10 further includes various mechanisms for moving certain body parts with respect to other body parts as described in detail below.

Referring again to FIGS. 1–6B, each of the body parts of the mechanical toy figure 10 are conventional and are preferably formed to simulate corresponding body parts of a human, of either sex, or a humanoid. However, it is within the scope of the present invention to construct a toy figure 10 that simulates an animal or a fantastical creature (neither shown). The lower torso 12 is preferably molded of a single piece of material and is hollow so as to provide a lower body cavity 13. The upper torso 14 is preferably constructed of a front shell half 22A and a rear shell half 22B, the two shell halves 22A, 22B being assembled together in a conventional manner to enclose an upper body cavity 15 and form a bottom wall 53 with an opening 54 extending therethrough.

Preferably, the upper torso 14 has a neck region 24 formed generally as the "ball" of a ball-and-socket joint and includes an opening 25 extending through the uppermost section of the neck region 24. The upper torso 14 also preferably has two shoulder regions 23A, 23B each at an opposite lateral side of the upper torso 14. Further, the head 16 is preferably hollow and has an opening 17 through a lower end providing a "socket" for the ball of the neck region 24 when the head 16 is rotatably secured to the upper torso 14 as described below.

Further, the toy figure 10 has a primary shaft 50 attached to the lower torso 12 and extending into the upper torso 14, preferably through the opening 54 and into the upper body cavity 15, which rotatably attaches the upper torso 14 to the lower torso 12 as described below. The primary shaft 50 is preferably an elongated cylindrical bar having a plug 55 at a lower end thereof that is fitted within an opening 56 through an upper wall of the lower torso 12 to fixedly attach the shaft 50 to the lower torso 12.

Referring to FIGS. 1–5B, the arms 18A, 18B are segmented. Each arm 18A, 18B has an upper arm section 26A, 26B rotatably connected to the body 11, specifically to the upper torso 14, and a lower arm section 28A, 28B rotatably attached to the upper arm section 26A, 26B, respectively.

Figure 3:
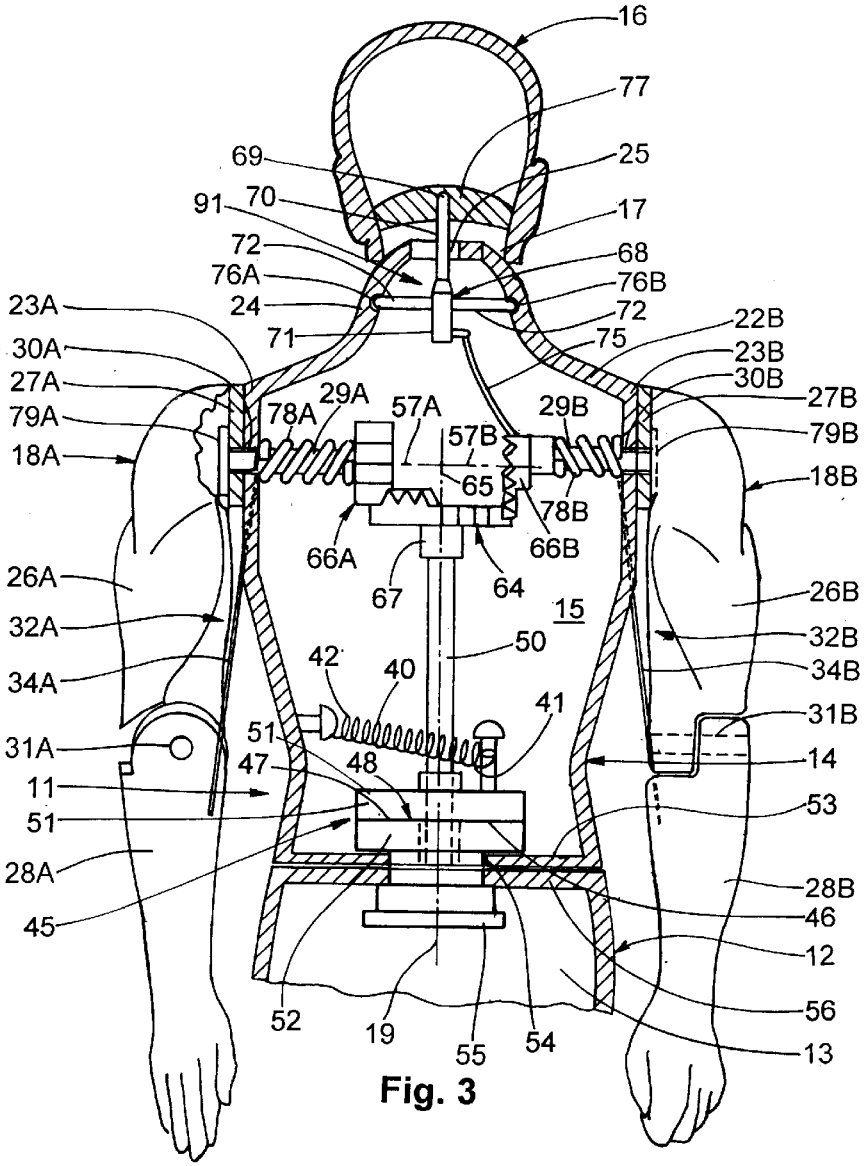
FIG. 3 is a front elevational view of the first embodiment toy figure with the front shell half of the upper torso portion removed, shown with both arms in a downward, fully extended position.

As best shown in FIG. 3, each upper arm section 26A, 26B has a connective portion 27A, 27B juxtaposed with the shoulder region 23A, 23B of the upper torso 14 and a stop plate 79A, 79B disposed within a hollow interior portion 21 (only one shown) and adjacent to the connective portion 27A, 27B. Each stop plate 79A, 79B is mounted to the outer end of an arm shaft 29A, 29B that extends into the upper torso 14 through a bearing opening 30A, 30B at the shoulder region 23A, 23B. The shafts 29A, 29B are rotatable within the openings 30A, 30B to enable the arms 18A, 18B to rotate about the upper torso 14. Further, a spring 78A, 78B is mounted about each arm shaft 29A, 29B and biases the shaft 29A, 29B inwardly such that the connective portion 27A, 27B is "sandwiched" between the plate 79A, 79B and the shoulder region 23A, 23B, respectively, of the upper torso 14. The sandwiching of the connective portion 27A, 27B releasably couples the arm 18A, 18B to the arm shaft 29A, 29B in the manner of a slip clutch so as to prevent damage to the toy figure 10 during rotation of the arms 18A, 18B, as explained below.

Figure 1:
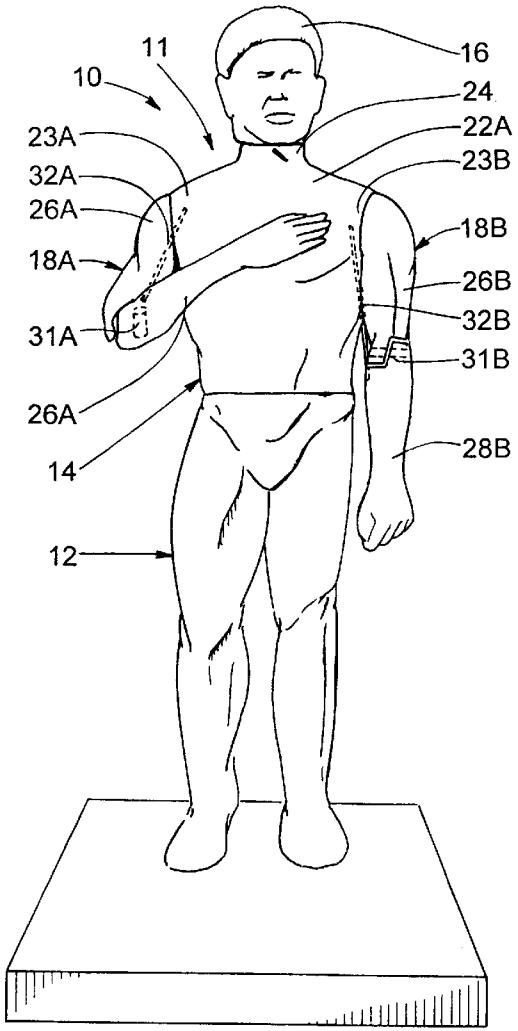
FIG. 1 is a perspective view of a mechanical toy figure in accordance with a first embodiment of the present invention.
Figure 5A:
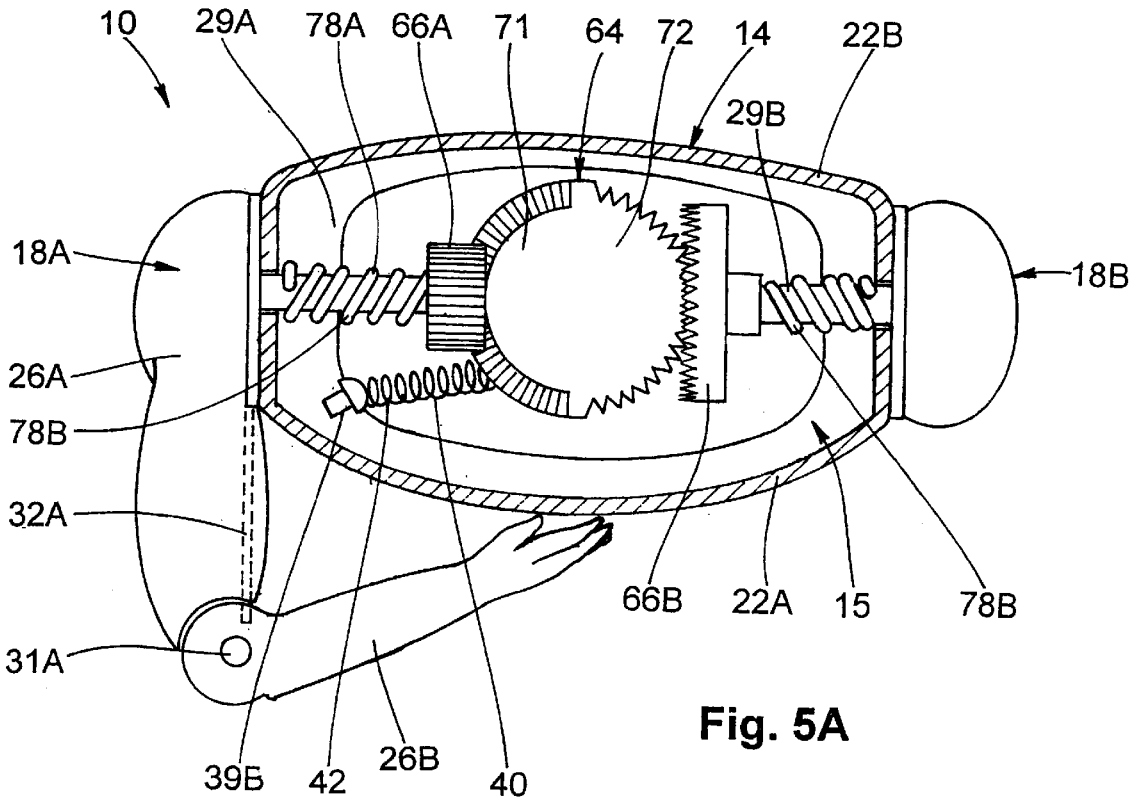
FIG. 5A is a broken away top plan view of the upper torso, gear train and the arms shown in a first position.

Preferably, the lower arm sections 28A, 28B are each rotatably attached to the upper arm sections 26A, 26B by a conventional pin-and-bearing pivot connection 31A, 31B, respectively. The pivot connections 31A and 31B are preferably each configured differently from the other so that each arm 18A or 18B executes a different motion. The pivot connection 31A on the left arm 18A enables the left lower arm section 28A to move vertically and also horizontally across the upper torso 14 of the figure 10 (FIGS. 1, 5A) . The pivot connection 31B of the right arm 18B enables the right lower arm section 28B to only move generally vertically along the right side the upper torso 14 (FIGS. 2, 5B), both motions being described in further detail below.

Referring to FIGS. 1–3, 5A and 5B, the mechanical toy figure 10 further comprises a linkage 32A or 32B attached to a lower arm section 28A, 28B and to the body 11 such that the lower arm section 28A or 28B rotates with respect to an upper arm section 26A or 26B as the upper arm section 26A or 26B rotates with respect to the body 11. Preferably, the toy figure 10 includes the two linkages 32A, 32B attached to each lower arm section 28A, 28B, respectively.

Preferably, each linkage 32A, 32B is provided by a cable 34A, 34B acting in conjunction with the upper and lower sections 26, 28, respectively, of the arms 18A, 18B. Each cable 34A, 34B has an upper end attached to the upper torso 14, preferably to a section of the shoulder region 24A, 24B on the rear shell half 22B, and a lower end attached to the lower arm section 28A, 28B. The upper arm sections 26A, 26B are each preferably hollow or contain a tunnel (neither shown) inside which at least the major portion of the cable 34A or 34B is disposed so as to be substantially hidden from view.

When the upper torso 14 rotates about the lower torso 12, the linkages 32A, 32B cause the lower arm sections 28A, 28B to move in two distinct manners as discussed above. More specifically, rotation of the upper torso 14 about the lower torso 12 causes the arms 18A, 18B to rotate about the upper torso 14 in opposite directions and operates the linkages 32A, 32B as follows.

When the arms 18A, 18B are rotated in a first relative direction so that the left arm 18A moves upwardly and the right arm 18B moves downwardly (FIG. 1), the downward movement of the right arm 18B causes the flexible cable 34B to become slack and allows the right lower arm section 28B to rotate, under its own weight, vertically downward along the right side of the upper torso 14 to the position shown. Simultaneously, the upward movement of the left arm 18A causes the flexible cable 34A to be placed under tension, so that the cable "pulls" the lower arm section 28A about the pivot 31A as the arm 18A moves upward, moving the lower arm section 28A both vertically upward and horizontally across the front of the upper torso 14 toward the center line 19 of the toy figure 10. When the arms 18A, 18B are rotated in a second, opposite direction so that the left arm 18A moves downwardly and the right arm 18B moves upwardly (FIG. 2), the cable 34A becomes slack and allows the left lower arm section 28A to "fall" vertically downwardly and horizontally away from the centerline 19 of the upper torso 14 and, simultaneously, the flexible cable 34B pulls the right lower arm section 28B about the pivot 31B to move the right lower arm section 28B vertically upward (FIG. 2).

Figure 5B:
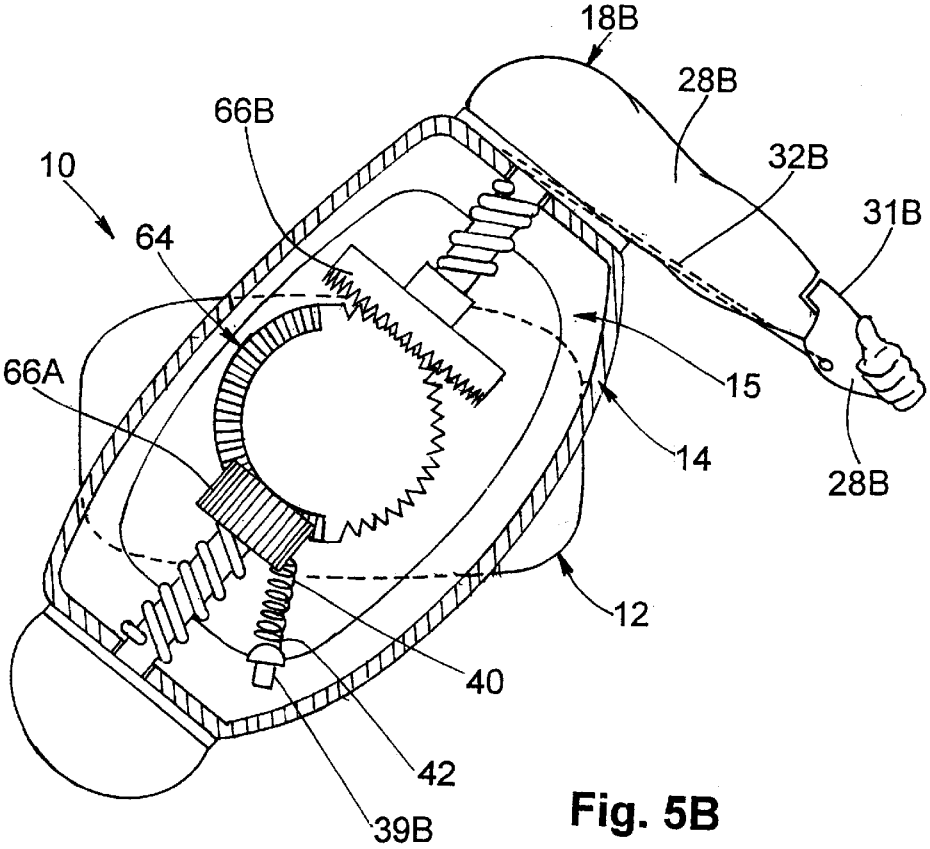
FIG. 5B is a view similar to FIG. 5A showing the upper torso, gear train and arms in a second position.

Referring now to FIGS. 3, 5A and 5B, the mechanical toy figure 10 further includes a means for rotating the upper torso 14 with respect to the lower torso 12 from a second position with respect to the lower torso 12 to a first position with respect to the lower torso 12. The toy figure 10 further comprises a spring 40 having a first end 41 connected with the lower torso 12 and a second end 42 connected with the upper torso 14. The spring 40 rotates the upper torso 14 from a second position (FIG. 1) with respect to the lower torso 12, where the spring 40 is deflected, to a first position (FIG. 2) with respect to the lower torso 14, where the spring 40 is undeflected. In other words, the torso spring 40 is positioned to bias the upper torso 14 toward a first position with respect to the lower torso 12.

Preferably, the torso spring 40 is a standard helical extension spring, although it is within the scope of the present invention to use another appropriate type of spring, such as a helical compression, a torsion or a cantilever spring (none shown), of either steel or an elastomeric material. Further, the spring 40 is preferably disposed completely within the upper body cavity 15 of the upper torso 14 and is connected to the lower and upper torsos 12, 14, respectively, through pin connections 39A, 39B, respectively. Most preferably, the first end 41 of the spring 40 is coupled with the primary shaft 50 and the second end 41 is attached to the inner wall surface of the upper torso 14.

Referring particularly to FIG. 3, the mechanical toy figure 10 further comprises means for retarding rotation of the upper torso 14 with respect to the lower torso 12, preferably hidden from view in the body 11. Preferably, such means further comprises a motion-damping mechanism 45 having a first end connected with the lower torso 12 and a second end connected with the upper torso 14 so as to retard rotation of the upper torso 14 about the lower torso 12. The motion-damping mechanism 45 also retards rotation of the arms 18A, 18B, and the head 16, about the upper torso 14, as explained below. Preferably, the motion-damping mechanism 45 is a friction means, most preferably a friction clutch, hidden from view in the upper torso 14, for retarding rotation of the upper torso 14 about the lower torso 12 when the upper torso 14 moves from the second position to the first position as described above.

Most preferably, the friction clutch of the motion damping mechanism or clutch 45 includes a first, friction surface 46 supported on the lower torso 12 and a second friction surface 47 supported on the upper torso 14 and frictionally coupled with the first surface 46. The first and second surfaces 46, 47 respectively, rotate with respect to each other when the upper torso 14 moves from the second position to the first position as described above. The clutch 45 is preferably constructed of a first cylindrical clutch plate 51 defining first surface 46 and attached to the lower torso 12 and a second cylindrical clutch plate 52 defining a second surface 47 and disposed beneath the first plate 51. Preferably, the second plate 52 has a lower portion disposed within the opening 54 through the bottom wall 53 of the upper torso 14 which attaches the second plate 52 to the upper torso 14. The first and second surfaces 46, 47, respectively, are each disposed on a portion of the first plate 51 or the second plate 52 facing the other plate 51 or 52.

Preferably, the first surface 46 of the friction clutch 45 is supported by the primary shaft 50 by fixedly mounting the first plate 51 to the shaft 50. The primary shaft 50, which is non-rotatably attached to the lower torso 12, extends through the lower end of the upper torso 14 and both the first and second plates 51, 52, respectively, of the clutch 45. The arrangement of the two plates 51, 52 of the friction clutch 45 results in interference between the upper, first clutch plate 51 (attached to the shaft 50 and thus lower torso 12) and the lower, second clutch plate 52 (attached to upper torso 14) which couples the upper torso 14 to the lower torso 12.

Still referring to FIG. 3, the clutch 45 preferably includes a viscous substance 48 with a tack, disposed between the first and second friction surfaces 46, 47 respectively, of the clutch 45. The viscous substance 48 increases the friction between the first and second surfaces 46, 47, respectively, of the clutch 45 to further retard rotation of the upper torso 14 about the lower torso 12. A suitable substance may be obtained from Jaeger Oil & Chemical Co., Ltd. of Japan, Product No. 0031S or 0868. However, it is within the scope of the present invention to provide any other conventional means to increase the friction between the two surfaces 46, 47 of the friction clutch 45, such as for example, providing a spring (not shown) to bias the first and second surfaces into contact with each other or providing a solid substance(s), such as one or more fabric pad(s) (not shown), disposed between the first and second surfaces 46, 47.

Figure 4:
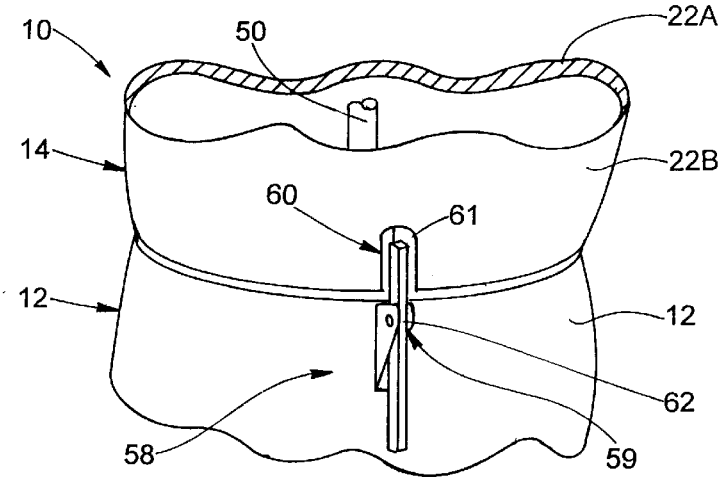
FIG. 4 is a broken-away rear perspective view of the toy figure showing the lock mechanism.

Referring now to FIG. 4, the mechanical toy figure 10 preferably includes a lock mechanism 58 having a first portion 59 attached to one of the upper torso 14 and the lower torso 12, preferably the lower torso 12, and a second portion 60 releasably engageable with a remaining one of the upper and lower torsos 14, 12, respectively, preferably the upper torso 14. The second portion 60 is spaced circumferentially about the upper torso 14 from the first portion 59 when the upper torso 14 is in the first position, and is disposed substantially adjacent to the first portion 59 when the upper torso 14 is in the second position so as to maintain the upper torso 14 in a second position with respect to the lower torso 12 when engaged.

Preferably, the first portion 59 of the lock mechanism 58 is a pivotable lever 62 attached to the lower torso and the second portion 60 is a recess molded in the upper torso 14 and having a ledge 61. A portion of the lever 62 is pivoted into the recess and disposed against the ledge 61 so that interference between the lever 62 and the ledge 61 prevents the torso spring 40 from biasing the upper torso 14 to rotate about the lower torso 12. However, it is within the scope of the present invention to construct and/or dispose the lock mechanism 58 in any other manner that enables the upper torso 14 to be maintained in a second position with respect to the lower torso 12. For example, the lock mechanism 58 can be a slidable key (not shown) attached to the lower torso 12 and configured to engage a slotted opening (not shown) in the upper torso 14, or a clamp (not shown) attached to either the upper or lower torsos 14, 12, respectively, and having a surface engageable with a surface on the other torso half.

Referring now to FIGS. 3–5A and 5B, the mechanical toy figure 10 further includes means for rotating the arms 18A, 18B with respect to the upper torso 14 as the upper torso 14 rotates about the lower torso 12, preferably in the form of a gear train 63 extending between the upper torso 14 and the lower torso 12. The toy figure 10 further comprises a drive gear 64 located within the upper torso 14 but connected with the lower torso 12 and having an axis 65, preferably co-linear with centerline 19, and at least one driven gear 66 disposed within the upper torso 14, connected with at least one of the two arms 18A, 18B and engaged with the drive gear 64.

Preferably, the toy figure 10 comprises two driven gears 66A, 66B engaged with the drive gear 64, each gear 66A, 66B being connected with a separate one of the arms 18A, 18B preferably by being mounted to a separate one of the arm shafts 29A, 29B and each having an axis 57A, 57B, respectively, extending perpendicular to and intersecting the axis 65 of the drive gear 64. The springs 78A, 78B mounted about each arm shaft 29A, 29B are each disposed between the inner surface of the upper torso 14 and the driven gear 66A, 66B mounted to the shaft 29A, 29B. Each spring 78A, 78B pushes against the inner surface of the upper torso 14 and against the driven gear 66A, 66B to bias the driven gear 66A, 66B in engagement with the drive gear 64 and, simultaneously, pulls the stop plate 79A, 79B toward the upper torso 14 to releasably couple the particular arm 18A, 18B to the arm shaft 29A, 29B, as described above. With this arrangement, the connective portions 27A, 27B of the upper arm sections 26A, 26B are able to slip against the stop plates 79A, 79B so that the arms 18A, 18B can rotate about the upper torso 14 even if the gear train 63 is "locked-up", preventing damage to the arms 18A, 18B and/or gear train 63. Further, the drive gear 64 is preferably concentrically supported by the primary shaft 50, and most preferably, the drive gear 64 is fixedly mounted to the primary shaft 50 so that the drive gear 64 is non-rotatable about the shaft 50 but rotates in common with the shaft 50 about axis 65, which extends longitudinally through and is coincident with a central longitudinal axis of the primary shaft 50.

Due to the above-described "bevel-type" arrangement of the drive gear 64 and the two driven gears 66A, 66B with the drive gear 64 being non-rotatable, rotation of the upper torso 14 with respect to the lower torso 12 causes the driven gears 66A, 66B to move or roll around the drive gear 64 and rotate the arms 18A, 18B in opposite directions. More specifically, release of the upper torso 14 from the second position (FIG. 1) with respect to the lower torso 12 spaced from the first position (FIG. 2), as described above, permits the spring 40 to bias the upper torso 14 to rotate about the lower torso 12 toward the first position and drive the driven gear(s) 66A, 66B about the drive gear 64 and so that at least one, and preferably both, of the two arms 18A, 18B rotate about the upper torso 14. The "rolling" of the driven gears 66A, 66B around the drive gear 64 is similar to the operation of a planetary gear train, with two planetary gears (i.e., driven gears 66A, 66B) being driven by a sun gear (i.e., drive gear 64).

Still referring to FIGS. 3, 5A and 5B, the drive gear 64 is formed as a "composite" gear having a first body-half 71 with gear teeth extending axially upward from the upper surface of the gear 64 in the manner of a "crown" gear, and a second body-half 72 with gear teeth that extend radially outward from the sidewall of the gear 64 in the manner of a spur gear. The drive gear 64 is mounted to the primary shaft 50 by inserting the upper end of the shaft 50 into the hub 67 of the gear 64. The left driven gear 66A is preferably a conventional spur gear mounted to the inner end of the left arm shaft 29A. As shown in FIGS. 3, 5A–6B, the right driven gear 66B is preferably formed as a half-crown gear having an offset hub 69 into which the inner end of the right arm shaft 29B is inserted. Each of the gears 64, 66A, 66B is fixed to the respective shaft 50, 29A, or 29B by conventional means, such as with a friction fit between the shaft and the gear or hub, an adhesive bond or a weld, a Woodruff key arrangement, or by any other conventional method.

Although the above-described arrangement and construction of the gears 64, 66A, 66B is preferred, it is within the scope of the present invention to construct a gear train 63 with any number of gears arranged in any appropriate manner that allows the toy figure 10 to function as described above and below. For example, the gears 64, 66A, 66B can be constructed as conventional bevel gears (not shown), or the driven gears 66A, 66B can be constructed as crown gears (not shown) with the drive gear 64 constructed as a spur gear (not shown) or vice-versa, each set being also arranged as a planetary gear train.

Figure 6B:
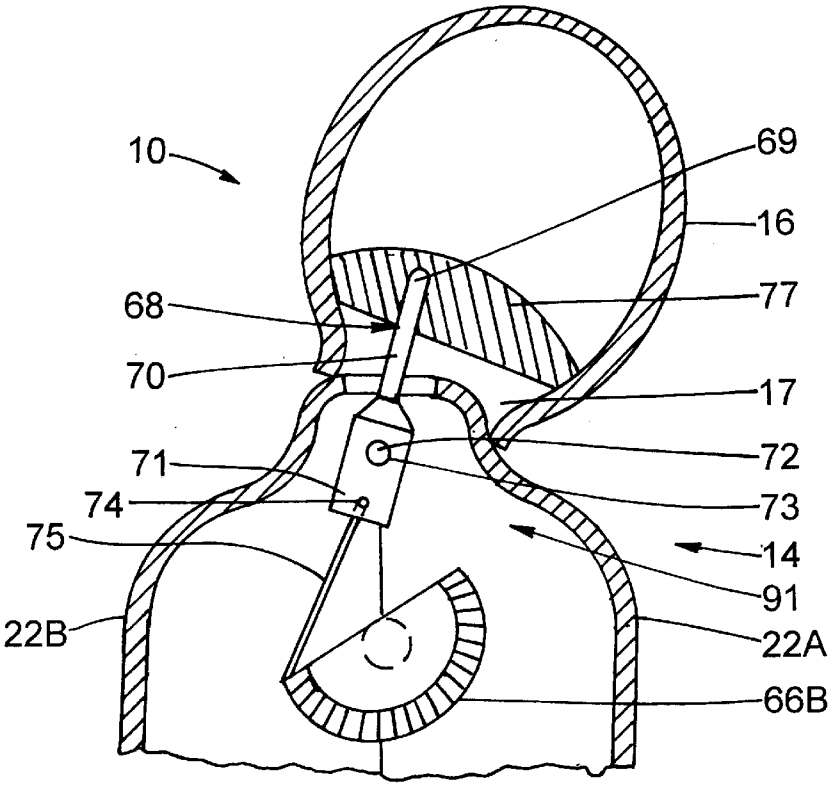
FIG. 6B is view of the mechanism of FIG. 6A showing a second position of the head and mechanism.
Figure 6A:
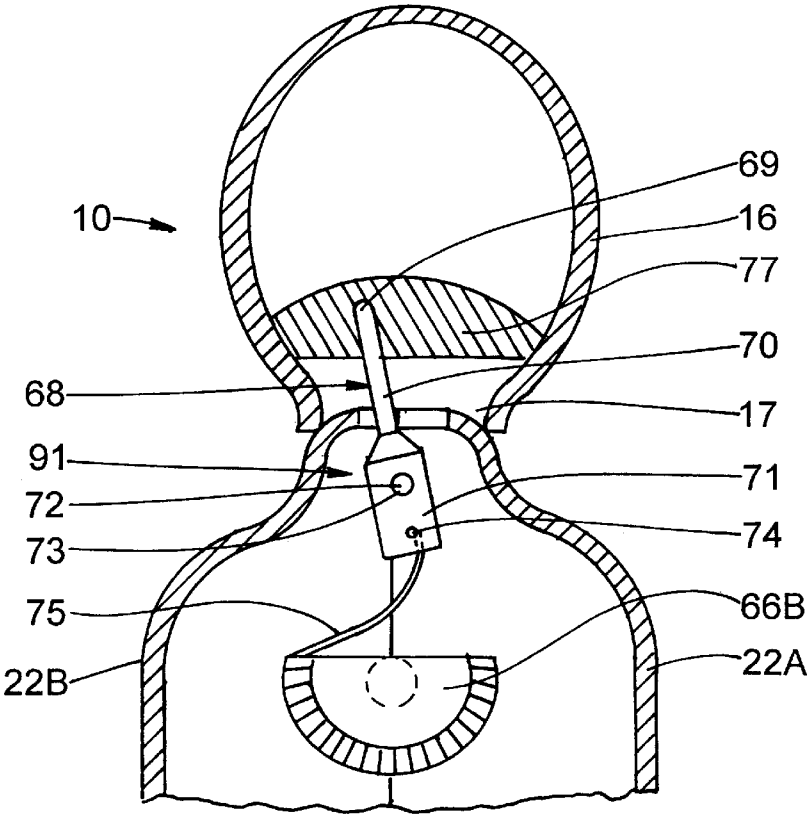
FIG. 6A is a greatly enlarged side elevational view in partial cross-section of the head-rotating mechanism.

Referring now to FIGS. 3, 6A and 6B, the mechanical toy figure 10 of the present invention further includes a head-rotating mechanism 91 for rotating the head 16 with respect to the upper torso 14. The head-rotating mechanism 91 of the toy figure 10 further comprises a neck shaft 68 having a first end 69 attached to the head 16, a center portion 70 extending into the upper torso 14 and a second end 71 in the upper torso 14. A pivot shaft 72 is attached to the upper torso 14 and extends generally perpendicular to the neck shaft 68, with the center portion 70 of the neck shaft 68 being attached to the pivot shaft 72. Further, a movable member, preferably one of the driven gears 66A or 66B and most preferably the right driven gear 66B, is connected to the second end 71 of the neck shaft 68 and connected with the lower torso 12 through the drive gear 64, such that rotation of the upper torso 14 with respect to (i.e. about) the lower torso 12 moves the movable member and pivots the neck shaft 68 about the pivot shaft 72. Preferably, the neck shaft 68 has a plug 77 mounted to the first end 69 that is inserted through the opening 17 into, or otherwise positioned in, the head 16 to secure the head 16 to the neck shaft 68, and thus also rotatably secure the head 16 to the upper torso 14.

Still referring to FIGS. 3, 6A and 6B, the head-rotating mechanism 91 preferably includes a link 75 having one end, an upper end, connected to the neck shaft 68 proximal to the second end 71 and another, lower end connected to the right driven gear 66B so that the head-rotating mechanism 91 operates as follows. When the gear 66B rotates from the position shown in FIG. 6A to the position shown in FIG. 6B, the connected link 75 "pulls" the second end 71 of the neck shaft 68 rearwardly, causing the neck shaft 68 to pivot about the pivot shaft 72 from the first position (FIG. 6A) to the second position (FIG. 6B), so that the first end 69 of the shaft 68A, and thus the connected head 16, move frontwardly about the upper torso 14. Further, when the right driven gear 66B rotates from the second position (FIG. 6B) to the first position (FIG. 6A), the connected linkage 75 "pushes" the second end 71 of the shaft 68 frontwardly, causing the neck shaft 68 to pivot about the pivot shaft 72 from the position shown in FIG. 6B to the position shown in FIG. 6A, so that the first end 71 of the shaft 68 and head 16 move rearwardly about the upper torso 14.

Preferably, the neck shaft 68 is constructed of an upper cylindrical portion extending from the first end 70 and connected to a lower rectangular portion having a through hole 73, through which the pivot shaft 72 extends, and a connective member 74 disposed near the second end 71 and configured for attachment of the upper end of the link 75. Further, each end of the pivot shaft 72 is preferably "trapped" within openings 76A, 76B between the walls of the two shell halves 22A, 22B. The link 75 is preferably a resilient elongated member that functions as a flat or leaf spring. The head plug 75 is preferably an elastic disk that compresses to be inserted into the opening 17 and then expands to press against the inner surfaces of the head 16. However, it is within the scope of the present invention to construct any or all of the components of the head rotating mechanism 91 in any other manner which enables the neck shaft 68 to pivot the head 16 as described above.

Preferably, the body parts of the toy figure, such as the upper and lower torsos, etc., are molded from pliable natural rubber or a synthetic rubber material, and the mechanism components, such as the gears, clutch plates, etc., are molded from a relatively hard polymeric material, for example, moldable acetal resin (i.e., Delrin™) or nylon. However, those skilled in the art will recognize that other materials and/or techniques can be used to construct the body parts and the specified mechanism components, such as for example, constructing the gears of cast aluminum. The present invention is intended to embrace all such appropriate alternative materials and processes.

Referring again to FIGS. 1–6B, before using the mechanical toy figure 10 of the present invention, a user must first "set" the toy figure 10 to an initial configuration of the body parts and mechanisms so that the figure can simultaneously execute the several mechanism-driven movements of the body parts as described above. To set the figure, the user rotates the upper torso 14 about the lower torso 12 from the first position shown in FIGS. 2 and 5B to the second position with respect to the lower torso 12 shown in FIGS. 1 and 5A. As the user rotates the upper torso 14 about the lower torso 12, the torso spring 40 deflects and stores spring energy, so that the user must engage the components of the locking mechanism 58 to maintain the upper torso 14 in the second position against the bias of the spring 40. Further, the upper and lower sections 26, 28 of each arm 18A or 18B and the head 16 all move from the orientations shown in FIG. 2 to the orientations shown in FIG. 1 by the rotation of the driven gears 66A, 66B (caused by the rotation of the upper torso 14 about the lower torso 12) and the accompanying movement of either the linkages 32A, 32B or the pivoting of the neck shaft 68, as described in detail above.

Thereafter, the mechanical toy figure 10 is operated by disengaging the lock mechanism 58 so that the upper torso 14 is free to rotate about the lower torso 12. Releasing the upper torso 14 from the second position with respect to the lower torso 12 causes the upper torso 14 to rotate about the lower torso 12 toward the first position and simultaneously rotates at the arms 18A, 18B and the head 16 about the upper torso 14, the rotations being retarded by the means for retarding, as described above and below. More specifically, the biasing force of the deflected torso spring 40 causes the upper torso 14 to rotate about the lower torso 12 from the second position to the first position in the manner described above. As the upper torso 14 rotates about the lower torso 12, the first and second surfaces 46, 47, respectively, of the friction clutch 44 rotate against each other and retard the rotation of the upper torso 14 so that it rotates relatively slowly about the lower torso 12 compared to how it would have rotated without the clutch 44.

As discussed above, the rotation of the upper torso 14 about the lower torso 12 causes the driven gears 66A, 66B, which are connected with the upper torso 14 through the arm shafts 29A, 29B, to roll around the drive gear 64, which is connected with the lower torso 12 through the primary shaft 50. The rotation of the driven gears 66A, 66B rotates the arms 18A, 18B in opposite directions as described above. The left arm 18A rotates from a generally upward position (FIG. 1) to a generally downward position (FIG. 2) as the left lower arm section 28A pivots under the influence of gravity about the left upper arm section 26A and moves horizontally away from the centerline 19 of the toy figure 10 and vertically downward away from the right upper arm section 26A. Simultaneously, the right arm 18B rotates from a generally downward position (FIG. 1) to a generally upward position (FIG. 2) as the right lower arm section 28B is pulled by linkage 32B to pivot about the right upper arm section 26B and moves generally vertically upward toward the right upper arm section 26B.

Finally, simultaneously with all of the above-described motions, the rotation of the right driven gear 68B from the position shown in FIG. 6A to the position shown in FIG. 6B causes the link 75 to pull rearwardly on the second end 71 of the neck shaft 68. The neck shaft 68 pivots about the pivot shaft 72 so that the first end 69 of the neck shaft 68 moves frontwardly, and thus the head 16 moves frontwardly from a generally upright position (FIG. 6A) to a generally tilted position (FIG. 6B).

The mechanical toy figure 10 executes each of the above-described movements simultaneously and at a controlled rate due to the friction clutch 45 or other motion-damping mechanism. As the friction clutch 45 retards the rotation of the upper torso 14 about the lower torso 12 and the rotation of the upper torso 14 causes the driven gears 66A, 66B to roll about the drive gear 64, the rotation of the arms 18A, 18B about the upper torso is also retarded by the friction clutch 45. Further, as the linkages 32A, 32B are driven by rotation of the arms 18A, 18B and the link 75 of the head-rotating mechanism 91 is driven by the right drive gear 66B, the rotations of the arms 18A, 18B and the head 16 about the upper torso 14 are also retarded by the friction clutch 45. The effect of retarding the rotation of the various body parts of the toy figure 10 is to produce slow, smooth movements which more closely simulate corresponding human motions than would occur without the friction clutch 45 or other motion-damping mechanism.

Figure 7:
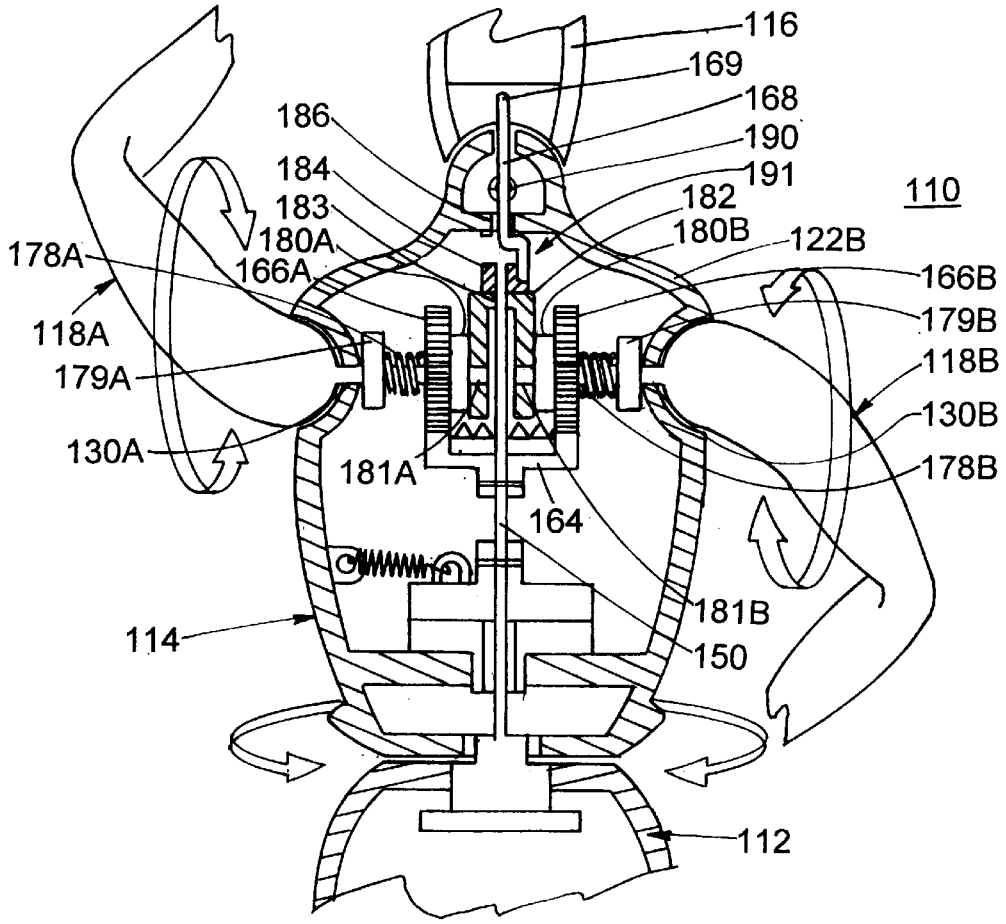
FIG. 7 is a broken-away, front elevational view of a mechanical toy figure in accordance with a second embodiment of the present invention.
Figure 8:
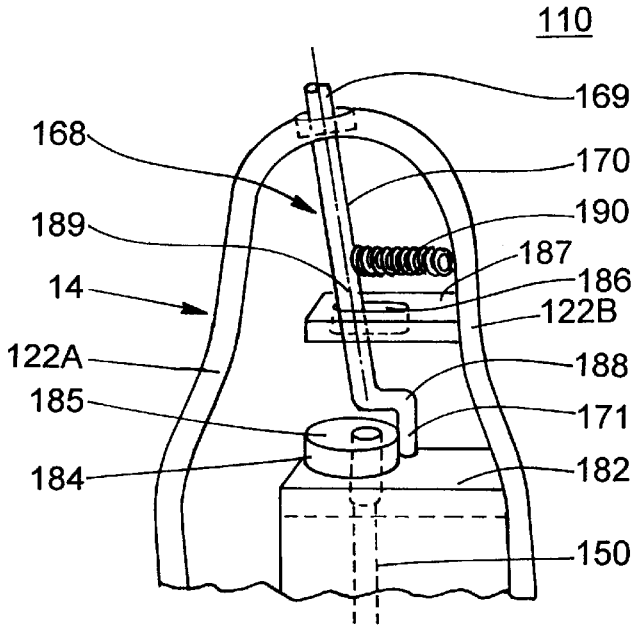
FIG. 8 is an enlarged, broken-away perspective view of an alternative head rotating mechanism used with the second embodiment toy figure.

Referring now to FIGS. 7 and 8, there is shown a second embodiment of the mechanical toy figure 110. The second embodiment of the toy figure 110 is similar to the first embodiment of the toy figure 10 as described above and functions in a similar manner. The primary differences between the second embodiment mechanical toy figure 110 and the first embodiment mechanical toy figure 10 are described in detail below.

As shown in FIGS. 7 and 8, the second embodiment mechanical toy figure 110 comprises the same body parts as the first embodiment toy figure 10, except that the arms 118A, 118B are each a one-piece construction, and thus do not have separate upper and lower arm sections. However, hinged arms (not shown) could also be used, if desired.

The second embodiment toy figure 110 includes various mechanisms for rotating the body parts of the toy figure 110 that are substantially similar to the above-described mechanisms of the first embodiment toy figure 10, but with the following differences. The driven gear 164 is preferably a conventional crown gear and is mounted to the primary shaft 150 so that the shaft 150 extends completely through the center of the drive gear 164. The two driven gears 166A, 166B are each formed as a conventional spur gear and are substantially identically sized and constructed.

Furthermore, each arm shaft 129A, 129B has an outer end fixedly attached to the particular arm 118A or 118B, a stop plate 179A, 179B mounted to the shaft 129A, 129B inside the upper torso 114 proximal to the bearing opening 130A, 130B and a second stop plate 180A, 180B fixedly attached near the inner end of the shaft 129A, 129B. Each driven gear 166A, 166B is slidably mounted about an arm shaft 129A, 129B and biased into contact with the stop plate 180A, 180B on the shaft 129A, 129B by the arm spring 178A, 178B, so as to releasably couple the gears 166A, 166B to the shaft 129A, 129B in the manner of a "slip clutch". The inner end of each arm shaft 129A, 129B extends into a separate bearing opening 181A, 181B in an "inverted-U" shaped bracket wall 182 extending from an inner wall of the rear-shell half 122B of the upper torso 114. The portion of the primary shaft 150 extending above the driven gear 164 extends through an opening 183 in the upper wall of the bracket wall 182.

The primary differences between the second embodiment toy figure 110 and the first embodiment toy figure 10 involve an alternative configuration of the head-rotating mechanism 191 and the absence of the linkages (i.e., 32A, 32B). As shown in FIGS. 7 and 8, an alternative head-rotating mechanism 191 includes a cam surface 184 connected with the lower torso 114 and a neck shaft 168 extending into the upper torso 114. The neck shaft 168 has a first end 169 attached to the head 116, a center portion 170 and a second end 171 contacting the cam surface 184. The neck shaft 168 is supported on the upper torso 114 such that rotation of the upper torso 114 about the lower torso 112 moves the second end 171 of the neck shaft 168 along the cam surface 184, thereby moving the head 116 with respect to the upper torso 114 in at least one direction, and preferably, in a first direction with respect to the upper torso 114 and alternately in a second, opposite direction with respect to the upper torso 114. The cam surface 184 is preferably provided by a plate 185 attached to and supported by the upper end of the primary shaft 150 and having an oval-shaped perimeter forming the cam surface 184.

Preferably, the neck shaft 168 is an elongated cylindrical bar having a bent portion 188 including the second end 171 of the shaft 168. The bent portion 188 is offset from an axis 189 extending co-linearly with a longitudinal center line of the neck shaft 168 (or at least a main portion of that shaft above the bent portion 188) and has a section of its outer surface in contact with the cam surface 184. Preferably, the toy figure 110 further includes a slot 186 in the upper torso 114, with the neck shaft 168 extending through the slot 186. The slot 186 is provided within a horizontal wall 187 extending from an inner surface of the upper torso 114. Further, a spring 190 has a first end attached to the upper torso 114 and a second end coupled with neck shaft 168 to bias the neck shaft 168 against the cam surface 184. The neck spring 190 pushes the center portion 171 of the neck shaft 168 toward the end of slot 186 most proximal to the plate 186 so as to bias the second end 172 of the shaft 168 against the cam surface 184 and to couple the neck shaft 168 with the upper torso 114.

Still referring to FIGS. 7 and 8, the alternate head-rotating mechanism 191 functions as follows. When the upper torso 114 is rotated about the lower torso 112, the second end 172 of the neck shaft 168 (coupled to the upper torso 114) circles around the plate 185 (fixed to the lower torso 112 through the primary shaft 150), so that the neck shaft 168 rotates about the vertical axis 189 and causes the head 116 to turn from side-to-side about the upper torso 116. Simultaneously, the movement of the second end 172 of the shaft 168 about the oval-shaped perimeter of the plate 185 causes the second end 172 to also move radially with respect to the plate 185. The radial movement of the second end 172 causes the shaft 168 to move within the slot 184 (against the biasing action of spring 190) to "rock" the head 116 alternately frontwardly and rearwardly about a horizontal axis (not shown) generally perpendicular to the center line of the neck shaft 168.

In use, the second embodiment toy figure 110 operates in manner similar to the operation of the first embodiment toy figure 10 with the following differences. As the arms 118A, 118B are one-piece constructions, neither arm has sections which move relative to each other. Further, the head 116 moves both generally frontwardly/rearwardly and turns from side to side with respect to the upper torso 114 as described above.

Figure 9:
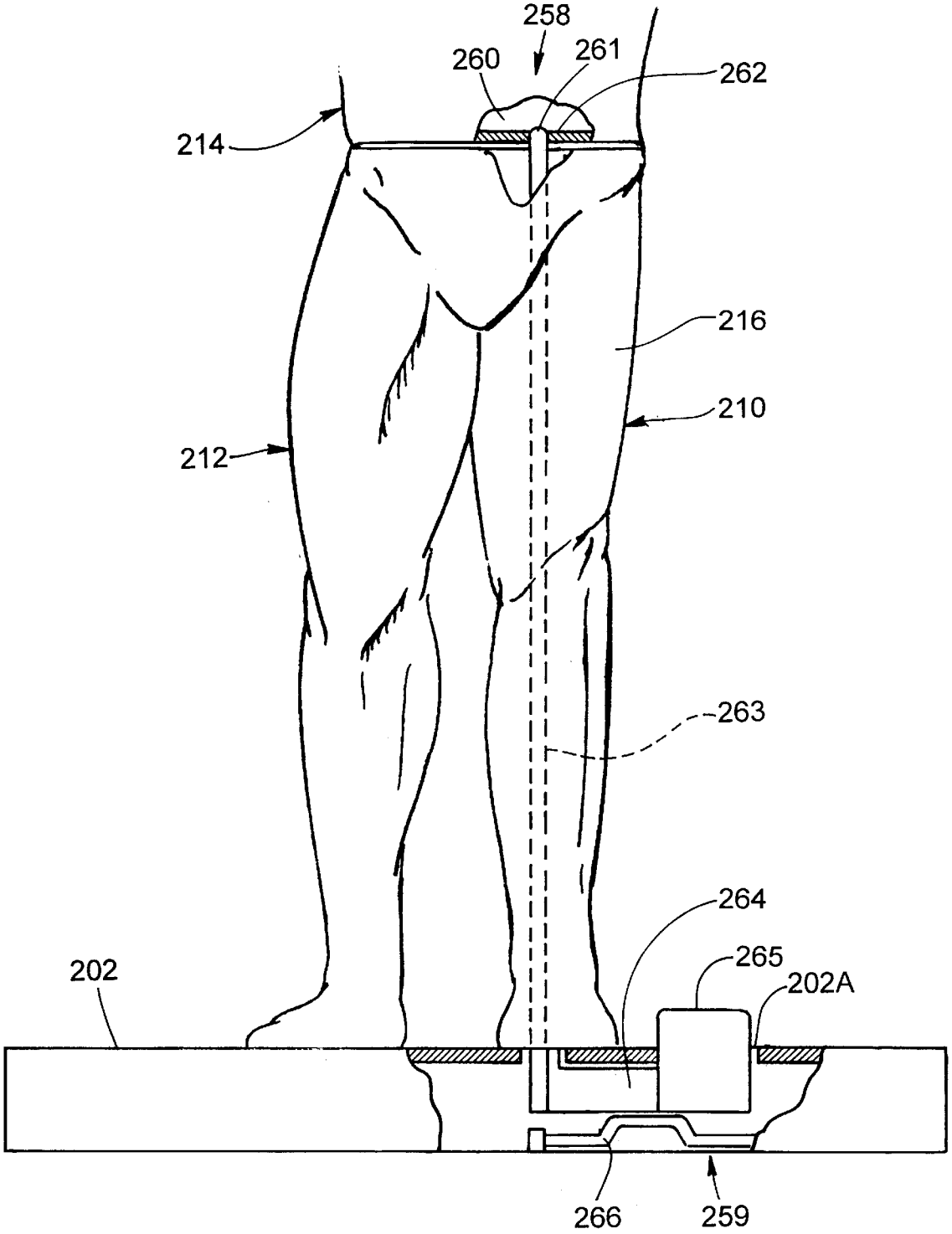
FIG. 9 is a broken-away front elevation of an alternative lock mechanism for releasably locking the upper torso against rotation with respect to the lower torso.

FIG. 9 depicts the operatively different parts of a third embodiment mechanical toy figure 210 which comprises the same body parts as the first embodiment toy figure and the second embodiment toy figure 110. The only difference is with respect to the lock mechanism.

FIG. 9 depicts the details of a modified lock mechanism 258 which again includes a first portion 259 attached to one of the upper and lower torsos 214, 212, in particular, the lower torso 212, and a second portion 260 releasably engagable with the remaining one of the upper and lower torsos, namely the upper torso 214. The first portion 259 is provided by the tip 262 of a long pin 263, which extends from the base 202 supporting the figure 210 up the inside of the left leg 216 of the figure. The long pin 263 forms one arm of a generally U-shaped member 264. The other arm of the member 264 forms a button 265 which extends through an opening 202*a* in the base 202. The member 264 and both of its "arms" 263 and 265 are biased upward by a spring 266 positioned for that purpose against the member 264, preferably in the base 202. The tip 262 is releasably received in a recess 261 provided on a bottom side of the upper torso 214. The tip 262 aligns with the recess 261 when the upper torso 214 is pivoted to its second position so as to engage with the recess and releasably maintains the upper torso 214 in the second position with respect to the lower torso 212 when engaged. Tip 262 is released from the recess 261 by simply depressing the button 265.

It will be appreciated by those skilled in the art that still other changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A toy figure comprising:

a lower torso;

an upper torso rotatably attached to the lower torso;

a spring having a first end connected with the lower torso and a second end connected with the upper torso so as to rotate the upper torso from a second position with respect to the lower torso where the spring is deflected to a first position with respect to the lower torso where the spring is undeflected; and friction means for retarding rotation of the upper torso about the lower torso when the upper torso moves from the second position to the first position.

2. The toy figure as recited in claim 1 wherein the friction means is a clutch having a first surface supported on the lower torso and a second surface frictionally coupled with the first surface and supported on the upper torso, such that the first and second surfaces rotate with respect to each other when the upper torso moves from the second position to the first position.

3. The toy figure as recited in claim 2 wherein the clutch includes a viscous substance disposed between the first and second surfaces of the clutch.

4. The toy figure as recited in claim 2 further comprising a primary shaft attached to the lower torso and extending into the upper torso and wherein the first surface is supported on the primary shaft.

5. The toy figure as recited in claim 4 wherein the first end of the spring is coupled with the primary shaft to connect the spring with the lower torso.

6. The toy figure as recited in claim 4 wherein the primary shaft extends through the second surface.

7. The toy figure as recited in claim 1 further comprising a lock mechanism having a first portion attached to one of the upper torso and the lower torso and a second portion releasably engageable with another of the upper and lower torsos so as to maintain the upper torso in the second position with respect to the lower torso.

8. The toy figure as recited in claim 1 further comprising:

two arms rotatably attached to the upper torso;

a drive gear connected with the lower torso; and two driven gears engaged with the drive gear, each driven gear being connected with a separate one of the arms, such that rotation of the upper torso with respect to the lower torso causes the driven gears to roll around the drive gear and rotate the arms in opposite directions.

9. The toy figure as recited in claim 8 wherein the friction means is a clutch having a first surface supported on the lower torso and a second surface frictionally coupled with the first surface and supported on the upper torso, such that the first and second surfaces rotate with respect to each other when the first torso moves from the second position to the first position, and further comprising a primary shaft attached to the lower torso and extending into the upper torso, the first surface of the clutch and the drive gear each being supported by the primary shaft.

10. The toy figure as recited in claim 1 further comprising:

a head rotatably attached to the upper torso;

a cam surface connected with the lower torso; and a neck shaft extending into the upper torso, the neck shaft being supported on the upper torso and having a first end connected with the head and a second end contacting the cam surface, such that rotation of the upper torso about the lower torso moves the second end of the neck shaft along the cam surface, thereby moving the head with respect to the upper torso in at least one direction.

11. The toy figure as recited in claim 10 wherein movement of the second end of the neck shaft along the cam surface moves the head in a first direction with respect to the upper torso and alternately in a second, opposite direction with respect to the upper torso.

12. The toy figure as recited in claim 10 further comprising:

a slot in the upper torso, the neck shaft extending through the slot; and a spring having a first end attached to the upper torso and a second end coupled with the neck shaft to bias the neck shaft against the cam surface.

13. The toy figure as recited in claim 10 further comprising a primary shaft attached to the lower torso and extending into the upper torso, the cam surface being supported by the primary shaft.

14. The toy figure as recited in claim 10 wherein the cam surface is a provided by a plate having an oval-shaped perimeter forming the cam surface and the second end moves around the perimeter of the plate to move the head in an oscillating manner.

15. The toy figure as recited in claim 10 wherein the neck shaft has a plug mounted to the first end, the head has an opening and the plug is inserted into the opening to secure the head to the neck shaft.

16. The toy figure as recited in claim 1 wherein the friction means and the spring are hidden from view.

17. The toy figure of claim 1 wherein the upper torso has two shoulder regions and further comprising:

two arms rotatably attached to a separate one of the shoulder regions of the upper torso, each arm having an arm shaft extending into the upper torso;

a drive gear connected with the lower torso and disposed within the upper torso, the drive gear having an axis; and two driven gears engaged with the drive gear, each driven gear being mounted to a separate one of the arm shafts and having an axis extending perpendicular to and intersecting the axis of the drive gear, such that rotation of the upper torso with respect to the lower torso causes the driven gears to roll around the drive gear and rotates the arms in opposite directions.

18. The toy figure as recited in claim 17 wherein each arm further includes a spring mounted to the arm shaft so as to bias the driven gear in engagement with the drive gear.

19. The toy figure as recited in claim 17 further comprising a primary shaft attached to the lower torso and extending into the upper torso, the drive gear being mounted on the primary shaft, the axis of the drive gear extending longitudinally through the primary shaft.

20. The toy figure as recited in claim 17 further comprising a friction clutch coupled between the upper torso and the lower torso so as to retard rotation of the driven gears about the driven gear and thereby retard rotation of the arms about the upper torso.

21. The toy figure as recited in claim 17 further comprising:

a head rotatably attached to the upper torso;

a cam surface connected with the lower torso; and a neck shaft, the neck shaft having a first end connected with the head and a second end contacting the cam surface, such that rotation of the upper torso about the lower torso moves the second end of the neck shaft along the cam surface, thereby moving the head with respect to the upper torso in at least one direction.

22. The toy figure of claim 1 further comprising:

at least one arm having an upper arm section rotatably connected to the upper torso and a lower arm section rotatably attached to the upper arm section; and a linkage attached to the lower arm section and to the body such that the lower arm section rotates with respect to the upper arm section as the upper arm section rotates with respect to the upper torso.

23. The toy figure as recited in claim 22 further comprising:

an arm shaft extending into the upper torso from the upper arm section;

a drive gear connected with the lower torso and located within the upper torso; and at least one driven gear engaged with the drive gear and mounted to the arm shaft such that rotation of the upper torso with respect to the lower torso causes the driven gear to roll around the drive gear, thereby rotating the upper section of the arm with respect to the torso.

24. The toy figure of claim 1 further comprising:

a head pivotally attached to the upper torso;

a neck shaft having a first end attached to the head, a center portion extending into the upper torso and a second end;

a pivot shaft attached to the upper torso and extending generally perpendicular to the neck shaft, the center portion of the neck shaft being attached to the pivot shaft; and a moveable member connected to the second end of the neck shaft and connected with the lower torso such that rotation of the upper torso with respect to the lower torso moves the moveable member and pivots the neck shaft about the pivot shaft.

25. The toy figure as recited in claim 24 further comprising a gear train extending between the upper torso and the lower torso and wherein the moveable member is a driven gear of the gear train.

26. The toy figure as recited in claim 25 further comprising at least one arm rotatably attached to the upper torso and connected with the driven gear such that rotation of the driven gear rotates the arm.

27. The toy figure as recited in claim 24 wherein the neck shaft has a plug mounted to the first end, the head has an opening and the plug is inserted into the opening to secure the head to the neck shaft.

28. A toy figure comprising:

a lower torso;

an upper torso rotatably attached to the lower torso;

two arms rotatably attached to the upper torso;

a spring having a first end connected with the upper torso and a second end connected with the lower torso, the spring being positioned to bias the upper torso toward a first position with respect to the lower torso;

a drive gear connected with the lower torso;

at least one driven gear disposed within the upper torso, connected with at least one of the two arms and engaged with the drive gear such that release of the upper torso from a second position with respect to the lower torso spaced from the first position permits the spring to bias the upper torso to rotate about the lower torso toward the first position and drive the driven gear about the drive gear so that the at least one of the two arms rotates about the upper torso; and a motion-damping mechanism having a first end connected with the lower torso and a second end connected with the upper torso so as to retard rotation of the upper torso about the lower torso and thereby retard rotation of the at least one of the arms about the upper torso.

29. The toy figure as recited in claim 28 having a second driven gear engaged with the drive gear, the second driven gear being connected with a remaining one of the arms.

30. The toy figure as recited in claim 28 wherein the motion-damping mechanism has a first friction surface connected with the lower torso, a second friction surface connected with the upper torso, the first and second friction surfaces being frictionally coupled together, such that the first and second surfaces rotate with respect to each other when the upper torso moves from the second position to the first position.

31. The toy figure as recited in claim 30 wherein the motion-damping mechanism further comprises a viscous substance disposed between the first and second friction surfaces.

32. The toy figure as recited in claim 28 further comprising:

a head rotatably attached to the upper torso;

a cam surface connected with the lower torso; and a neck shaft, the neck shaft having a first end connected with the head and second end contacting the cam surface, such that rotation of the upper torso about the lower torso moves the second end of the neck shaft along the cam surface, thereby moving the head with respect to the upper torso in at least one direction.

33. The toy figure as recited in claim 28 further comprising a lock mechanism having a first portion attached to one of the upper torso and the lower torso and a second portion releasably engageable with a remaining one of the upper and lower torsos, the lock mechanism maintaining the upper torso in a second position with respect to the lower torso.

34. A toy figure comprising:

a lower torso;

an upper torso rotatably attached to the lower torso;

two arms rotatably attached to the upper torso;

biasing means for rotating the upper torso with respect to the lower torso from a second position with respect to the lower torso to a first position with respect to the lower torso;

means for rotating the arms with respect to the upper torso as the upper torso rotates about the lower torso; and means for retarding rotation of the upper torso with respect to the lower torso;

wherein releasing the upper torso from the second position with respect to the lower torso causes the biasing means to rotate the upper torso about the lower torso toward the first position and simultaneously rotates the arms about the upper torso, the rotations being retarded by the means for retarding.

* * * * *